US005639249A

United States Patent [19]

Lenoir

[11] Patent Number: 5,639,249

[45] Date of Patent: Jun. 17, 1997

[54] PRINTED CIRCUIT BOARD CONNECTOR

[75] Inventor: Michel Lenoir, Montfort le Gesnois, France

[73] Assignee: Framatome Connectors International, Paris la Defense, France

[21] Appl. No.: 54,068

[22] Filed: Apr. 29, 1993

[30] Foreign Application Priority Data

Apr. 29, 1992 [FR] France ..... 92 05285

[51] Int. Cl.[6] ..... H01R 9/09

[52] U.S. Cl. ..... 439/79; 439/686

[58] Field of Search ..... 439/78, 79, 80, 439/82, 83, 701, 695, 696, 686, 688, 689

[56] References Cited

U.S. PATENT DOCUMENTS

| | | | |
|---|---|---|---|
| 3,601,762 | 8/1971 | Eshelman | 439/79 |
| 4,125,935 | 11/1978 | Ammon | 29/629 |
| 4,469,387 | 9/1984 | McHugh | 439/79 |
| 4,857,017 | 8/1989 | Erk | 439/79 |
| 4,917,616 | 4/1990 | Demler, Jr. et al. | 439/101 |
| 4,955,819 | 9/1990 | Harting et al. | 439/79 |
| 5,013,262 | 5/1991 | Shibano | 439/610 |
| 5,046,952 | 9/1991 | Cohen et al. | 439/79 |
| 5,066,240 | 11/1991 | Verdun | 439/181 |
| 5,184,963 | 2/1993 | Ichikawa | 439/79 |
| 5,252,080 | 10/1993 | Pesson | 439/80 |

FOREIGN PATENT DOCUMENTS 0335160 of 0000 European Pat. Off. .

*Primary Examiner*—Gary F. Paumen
*Assistant Examiner*—Hein D. Vu
*Attorney, Agent, or Firm*—Pollock, Vande Sande & Priddy

[57] ABSTRACT

A printed circuit board connector, in particular a press-fit connector, comprises an insulative body carrying a series of contacts which are parts of right-angled pins extended rearwardly by proximal branches substantially perpendicular to the board having a profile adapted to enable their insertion. An insulative body comprises slots for receiving the right-angled pins. Each slot has a bearing surface parallel to the board to which pressure may be applied when press-fitting the profiles. They also have a second bearing surface substantially perpendicular to the board for locating the proximal branches in the direction in which the connection members are inserted.

8 Claims, 2 Drawing Sheets

PRINTED CIRCUIT BOARD CONNECTOR

BACKGROUND OF THE INVENTION

1. Field of the Invention

The present invention concerns a printed circuit board connector, such as a press-fit printed circuit board connector, having right-angled pins.

2. Description of the Prior Art

A connector of this kind comprises an electrically insulative body carrying a series of right-angled pins whose proximal branches (relative to the printed circuit board) are substantially perpendicular to the board and have a profile enabling them to be force-fitted into through-plated holes in the printed circuit, and whose distal branches (relative to the board) are substantially parallel to the board and fastened to an active part disposed in the insulative body and configured as male or female connection members.

In theory, the pins are forced-fitted into the through-plated holes of the board once and for all, but it is possible to demount the connector two or three times, to carry out repairs, for example. The connection members carried by the distal branches of the pins are intended to provide a substantially demountable electrical connection, for example with a rectangular connector.

A press-fit connector is usually mounted on the board by pressing directly on the bent portions of the pins in order to force them into the aligned through-plated holes. The nominal insertion force is high (in the order of 50N per pin).

A drawback of this operation is that it requires tooling specific to each connector in order to apply pressure simultaneously and uniformly to each pin of the connector.

Also, it is desirable for the pins to be held accurately in place so that they are aligned with the holes, especially in the case of right-angled pins which are to be soldered to a printed circuit.

The invention proposes to remedy this drawback by means of a connector whose insulative body has a specific geometry enabling pressure to be applied simultaneously to all the contacts when inserting the connector into the printed circuit board.

SUMMARY OF THE INVENTION

The invention is a printed board connector having a front part comprising a first insulative body in which are disposed connection members having a distal end configured as a connection contact, a distal branch substantially parallel to the board, a right-angled bend joining the distal branch to a proximal branch of the connection member substantially perpendicular to the board, a proximal end having a profile enabling its insertion in a through-plated hole of the board, and a second insulative body having superposed slots adapted to receive at least two connection members in a common plane perpendicular to the board, each slot having a first surface substantially parallel to the board and adapted to enable pressure to be applied to the distal branches during insertion of the proximal ends into the board and a second surface substantially perpendicular to the board to hold the proximal branches in position.

Each slot may have third and fourth lateral surfaces adapted to locate the proximal branches in the direction in which connecting members are inserted.

In one advantageous embodiment of the invention, the slots for different rows of contacts have different lengths parallel to and perpendicular to the board.

In one preferred embodiment of the invention, each slot has a first part forming an insertion slot opening into an upper surface of the insulative body and having a fifth surface substantially perpendicular to the board to receive a proximal end of a proximal branch of a connection member inserted vertically through the upper surface and a sixth surface, substantially parallel to the board to form an abutment for the distal branch of the connection member, and a second part forming a holding slot and providing at least the first surface, whereby the first surface cooperates with the distal branch after horizontal insertion.

The vertical distance between the first surface and the sixth surface is advantageously substantially greater than the height of a distal branch of a connection member.

The insulative body may have stand-offs of accurately defined height near the profiles. These determine the sleeving depth in the case of a press-fit connector and compensate for manufacturing tolerances and for compaction (elastic compression) of the rear insulation during insertion in order to achieve complete insertion of the pins.

Locking arms may be provided at the opposite longitudinal ends of the second insulative body. The first insulative body may be fixed in a casing, the second insulative body being mounted on the housing by cooperation between the locking arms and notches at opposite longitudinal ends of the casing.

Other features and advantages of the invention will emerge from the following description with reference to the drawings.

DETAILED DESCRIPTION OF THE INVENTION

Figure 1A:
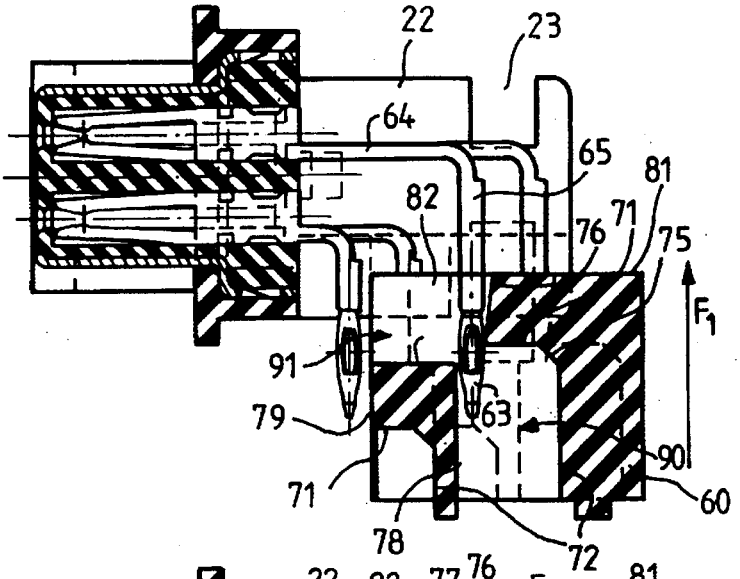
FIGS. 1A through 1C show, in vertical cross-section on the line B—B in FIG. 3, three stages in the assembly of a connector in accordance with the invention.

As shown in the drawings, a rectangular connector 5 has an insulative central block 10 with a rear part 11 and a front part 32 whose contour is within that of the rear part 11. Male or female contacts 70 which are part of right-angled pins 61 are disposed in the block 10. The longitudinal ends 17 of the insulative central block 10 include a beam member 41 extended by two elastic arms 42 and 43 perpendicular to it. The beam member 41 is locked by a peg 50 having an inclined profile 51 and an abutment region 53. A shielding cap 3 surrounds at 34 the front part 32 of the insulative block 10 and at 38 the upper and lower portions of the rear part 11. It is abutted at 35 between the latter and a frame (28-25) of a casing 1 made of a conductive material, for example. The metal body forming the casing 1 has a rear surface with upper and lower longitudinal edges 28 and 29 and two trihedra made up of mutually perpendicular members 22, 24 and 25 for fixing the casing 2 to a support such as a subrack or a printed circuit board by means of openings 24'.

Each trihedron has a vertical member 25 extending the upper edge 28 towards the lower edge 29 and a vertical member 22 perpendicular to the upper edge 28 and joined to the member 25. The lower edge 29 extends between the two members 22. The trihedron is completed by a horizontal member 24. The members 22 include notches 23 adapted to cooperate with the ends 67 of the elastic arms 66 disposed at the longitudinal ends of an insulative body 60.

The front part 32 includes openings 16 in which are accommodated the contacts 70 which extend rearwards in the form of right-angled pins 61.

The rear part of the press-fit connector 4 includes the aforementioned insulative central body 60 in which the right-angled pins 61 are accommodated at 62. The pins comprise a proximal branch 65 (relative to the board) extended by profiles 63 which may be of the type for press-fit insertion into a through-plated hole in a printed circuit board 80.

Figure 3:
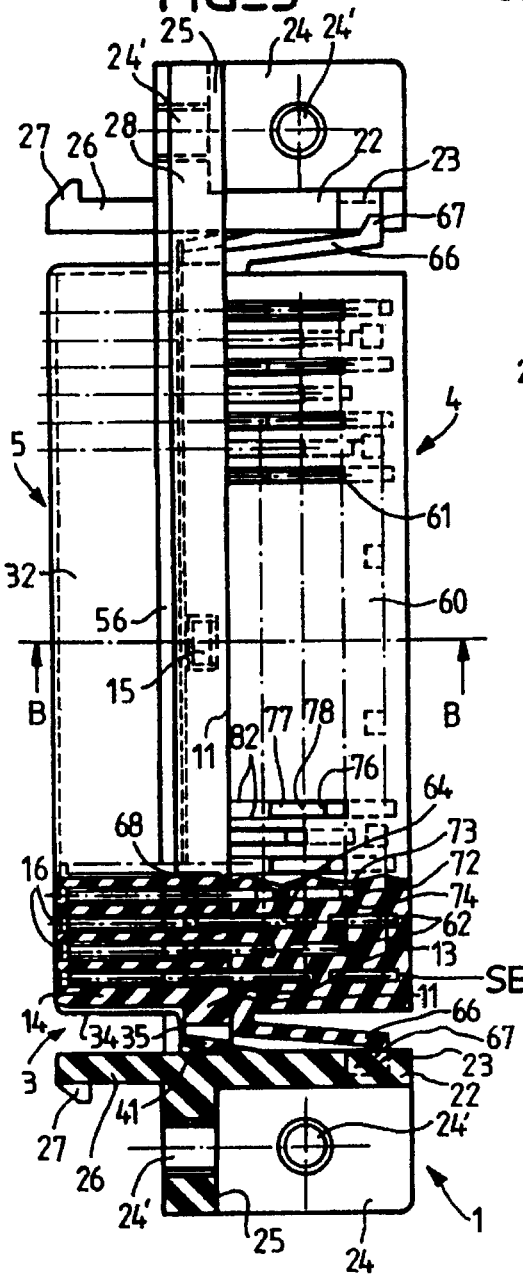
FIG. 3 is a top plan view partially in cross-section of an assembled connector in accordance with the invention and FIG. 3A is a detail of FIG. 3.
Figures 2, 2A:
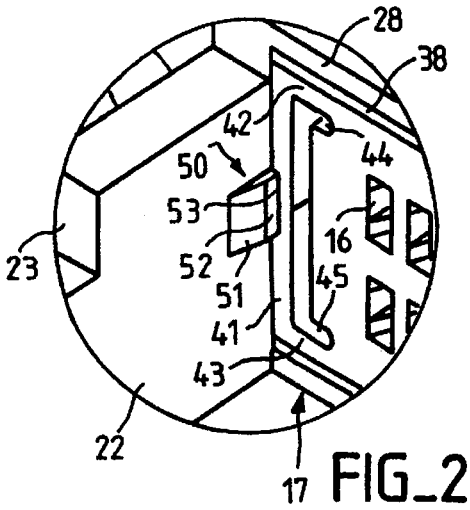
Figure 2B:
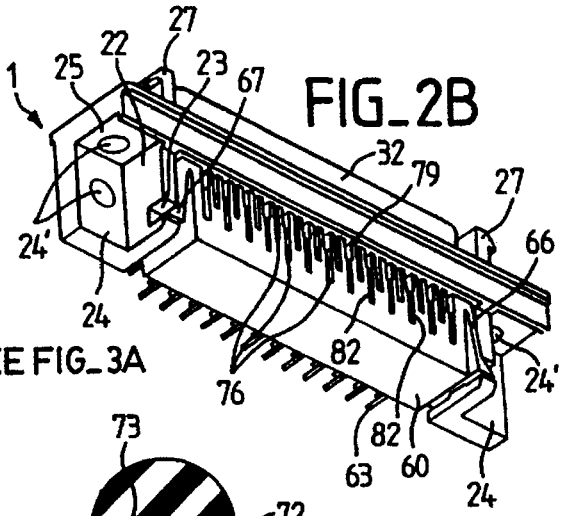
Figure 3A:
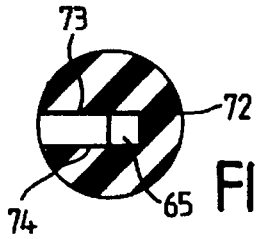

The distal branch 64 (relative to the board 80) contacts a bearing surface 71 of a slot 90. The bearing surface 71 is substantially parallel to the board 80 and therefore constitutes a bearing surface enabling insertion of the profiles 63, in particular press-fit insertion. The proximal branches 65 are surrounded by second, third and fourth lateral surfaces 72, 73, 74 of the slot. These surfaces 72, 73, 74 have a U-shape cross-section and surround the proximal branches 65 in the direction in which the profiles 63 are inserted and perpendicular to either side of the insertion direction (see insert in FIG. 3).

The slots 90 are of unequal length both perpendicular to the board and parallel thereto and that two different length pins are disposed in the same vertical plane (cross-section plane B—B). A connector is assembled starting with an insulative body 10 mounted in a substantially conductive casing 1.

The geometry of the central body 60 having the slots 90 firstly (FIG. 1A) enables insertion of the distal end of the right-angled pins 61 through the upper surface 81 of the insulative body 60 by vertical displacement of the insulative body 60 in the direction of the arrow $F_1$. During this first assembly stage, the proximal branches 65 slide along vertical fifth surfaces 76 which are part of the insertion slots 91, except for the row of pins in the immediate vicinity of the front part 11 which are in contact with the front surface 79 of the insulative body 60. The vertical fifth surfaces 76 are slightly inclined to guide the profiles 63. Vertical surfaces 78 opposite the surfaces 76 but in a lower part of the insulative body 60 cooperate with the surfaces 76 to guide the profiles 63 and the proximal branches 65 over a substantial proportion of the vertical travel of the insulative body 60.

At the end of this first assembly stage (position shown in FIG. 1B) the distal branches 64 are practically abutted against horizontal sixth surfaces 77 (except for the row of pins 61 nearest the front part 11) and lateral movement thereof is limited by the vertical edges 82 surrounding the horizontal sixth surfaces 77. The horizontal surfaces 77, the vertical edges 82 and the vertical surfaces 76 therefore define slots 91 for insertion of the right-angled pins 61.

Figure 1B:
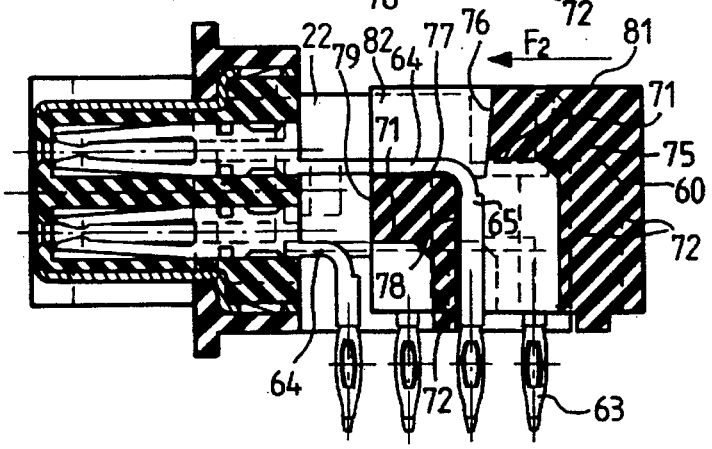
Figure 1C:
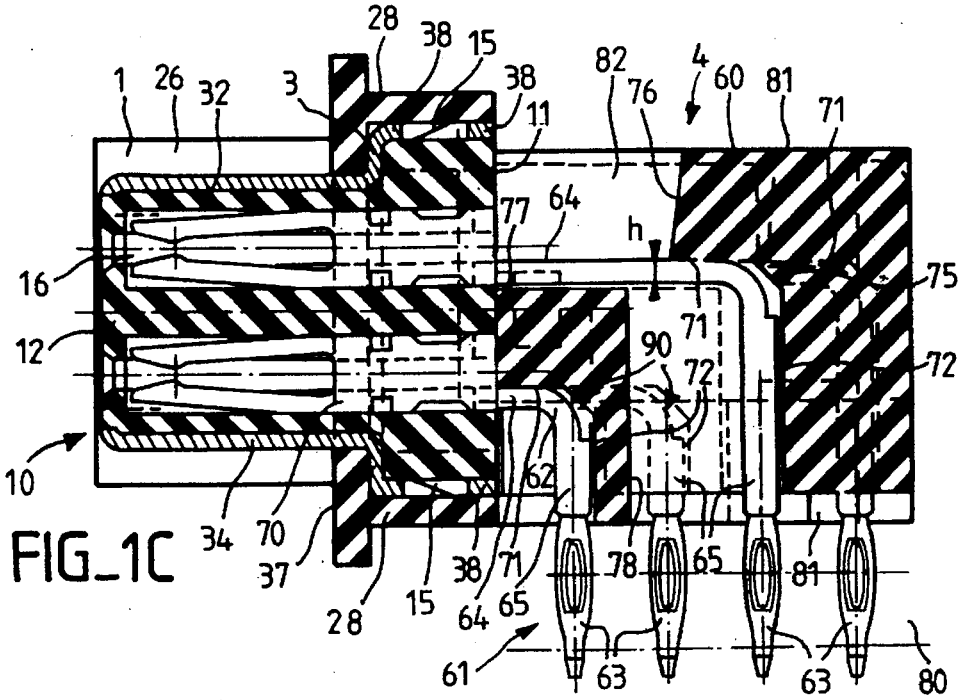
Figures 1, 2A:
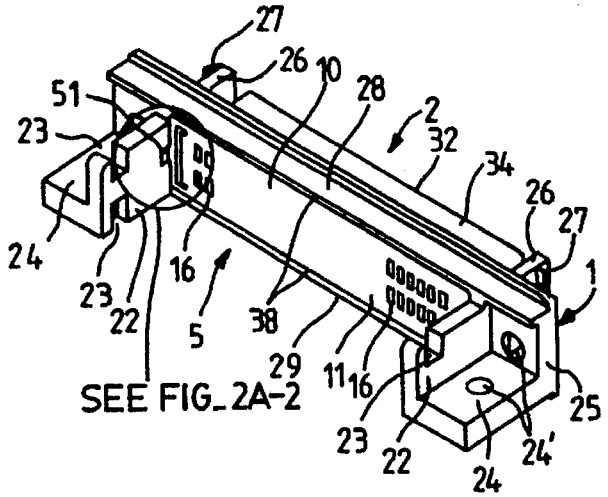
FIGS. 2A-1, 2A-2 and 2B are perspective views of a rectangular connector, FIG. 2A-2 showing a detail of FIG. 2A-1, and FIG. 2B showing an assembled connector in accordance with the invention.

The second stage of assembly requires relative horizontal displacement in the direction of the arrow $F_2$ in FIG. 1B until the ends 67 of the elastic arms 66 snap into the notches 23 to locate the right-angled pins 61 in the locating slots 90 (position shown in FIG. 1C). The proximal branches 65 are in the immediate vicinity of the vertical edges 72 and the proximal branches are abutted against horizontal edges 71 and lateral displacement thereof is limited by the vertical edges 73 and 74 surrounding the surfaces 71 and 72 (see insert in FIG. 3). The right-angled bends 92 face facets 75 joining the surfaces 71 and 72. The horizontal surfaces 71, the vertical surfaces 72 and the vertical edges 73 and 74 therefore define slots 90 for locating the right-angled pins 61 and communicating with the aforementioned insertion slots 91. Specifically, the vertical distance between the horizontal surfaces 71 and 77 in the case of coplanar right-angled pins 61 is substantially greater than the height h of the proximal branches 64.

Upon insertion of the profiles 63 into a printed circuit board 80, and in the case of press-fit insertion in particular, the horizontal surfaces 71 act as bearing surfaces and the insulative central body 60 serves as an insertion member, the insertion press tool bearing on the upper surface 81 of the body 60.

There is hence no requirement for any additional part or tooling.

The connector 4 is fixed into the rectangular connector 11, by cooperation between elastic lugs 66 at the longitudinal ends of the body 60 and notches 23 on the trihedron members 22. There are hence four lugs 66 and four notches 23, the notches being so disposed that they enable some play between the insulative bodies 60 and 10. The insulative body 60 ensures accurate relative positioning between the ends 63 when they are inserted.

Stand-offs 81 of accurately defined height disposed at the bottom of the insulative block 80 determine the sleeving depth in the case of a press-fit connector and compensate for manufacturing tolerances.

The device described hereinabove can be used in a connector such as that disclosed in applicant's French Patent Application FR 91-15295, filed Dec. 10, 1991, namely a press-fit connector comprising an insulative body having a generally angle-iron shape member with a mounting flange and a connecting flange and a member forming a pressure block having bearing surfaces bearing against the distal branches of the pins.

There is claimed:

1. A printed circuit board connector having a front part comprising:

(a) a first insulating body in which are disposed a plurality of connection members, each of said connection members having a distal end configured as a receptacle connection contact, a distal branch substantially parallel to said board, a right-angled bend joining said distal branch to a proximal branch of each said connection member substantially perpendicular to said board, and a proximal end having a profile enabling insertion of said proximal end in a through-plated hole of said board; and (b) a one-piece second insulating body having superposed slots adapted to receive at least a first and a second of said connection members in a common plane perpendicular to said board, each of said slots including an L-shaped wall member having a first surface substantially parallel to said board and a second surface substantially perpendicular to said board to hold said proximal branches in position, said second insulating body being vertically inserted between said connection members from below said first insulating body in a direction perpendicular to said board and subsequently moved horizontally parallel to said board to a final assembled position, said first surface adapted to enable downward insertion pressure to be applied to said distal branches during insertion of said proximal ends into said board.

2. The connector according to claim 1 wherein said proximal ends have press-fit profiles.

3. The connector according to claim 1 wherein some of said slots have third and fourth lateral surfaces adapted to locate said proximal branches in a direction in which said connection members are inserted.

4. The connector according to claim 1 wherein said slots for different rows of contacts have different lengths parallel to and perpendicular to said board connector.

5. The connector according to claim 1 wherein some of said slots have a first part forming an insertion slot opening into an upper surface of said second insulating body and have a fifth surface substantially perpendicular to said board to receive the proximal end of the proximal branch of a respective said connection member inserted vertically through said upper surface and a sixth surface substantially parallel to said board to form an abutment for said distal branch of said connection member and a second part providing at least said first surface.

6. The connector according to claim 5, wherein a vertical distance between said first surface and said sixth surface is greater than a height of a distal branch of a connection member.

7. The connector according to claim 1 wherein said second insulating body has locking arms at opposite longitudinal ends.

8. The connector according to claim 7, wherein said first insulating body is adapted to be fixed in a casing and said second insulating body is adapted to be mounted on said casing by cooperation between said locking arms and notches at opposite longitudinal ends of said casing.

* * * * *